US008200116B2

(12) United States Patent
Miyamoto

(10) Patent No.: US 8,200,116 B2
(45) Date of Patent: Jun. 12, 2012

(54) CLEANING DEVICE FOR ROTARY MEMBER, CHARGING DEVICE AND IMAGE FORMING APPARATUS INCLUDING THE SAME

(75) Inventor: Hidetoshi Miyamoto, Osaka (JP)

(73) Assignee: KYOCERA MITA Corporation, Osaka (JP)

( * ) Notice: Subject to any disclaimer, the term of this patent is extended or adjusted under 35 U.S.C. 154(b) by 409 days.

(21) Appl. No.: 12/539,993

(22) Filed: Aug. 12, 2009

(65) Prior Publication Data

US 2010/0119251 A1 May 13, 2010

(30) Foreign Application Priority Data

Nov. 12, 2008 (JP) ..... 2008-289422

(51) Int. Cl.
*G03G 15/02* (2006.01)

(52) U.S. Cl. ..... 399/100; 399/347; 399/353

(58) Field of Classification Search ..... 399/100, 399/347, 353
See application file for complete search history.

(56) References Cited

U.S. PATENT DOCUMENTS 5,619,311 A * 4/1997 Kurokawa et al. ..... 399/176
6,757,505 B2 6/2004 Amemiya et al.
7,224,929 B2 * 5/2007 Facci et al. ..... 399/347
7,266,324 B2 * 9/2007 Yanagida et al. ..... 399/100
2003/0044196 A1 * 3/2003 Amemiya et al. ..... 399/100

FOREIGN PATENT DOCUMENTS

CN 1791707 A 6/2006
JP 2006-276134 10/2006

* cited by examiner

*Primary Examiner* — David Gray
*Assistant Examiner* — G. M. Hyder
(74) *Attorney, Agent, or Firm* — Frommer Lawrence & Haug LLP

(57) ABSTRACT

A cleaning element for an image forming apparatus, such as a printer. The cleaning element may include a brush, which may include a support structure and brush filaments extending therefrom. Each of the brush filaments has a tip at the distal end from the support structure and may be configured to contact a surface of a member to be cleaned. An inorganic microparticle may be bonded at or proximate to the tip by a discharge product as an adhesive. Thus, it is possible to provide a cleaning element capable of removing material adhering to the surface of the member to be cleaned. The cleaning element is capable of providing long-term effective cleaning of a member of an image forming apparatus during extended use.

20 Claims, 4 Drawing Sheets

CLEANING DEVICE FOR ROTARY MEMBER, CHARGING DEVICE AND IMAGE FORMING APPARATUS INCLUDING THE SAME

INCORPORATION BY REFERENCE

This application is based upon and claims the benefit of priority from the corresponding Japanese Patent application No. 2008-289422, filed Nov. 12, 2008, the entire content of which is incorporated herein by reference.

FIELD OF THE INVENTION

The present invention relates to a cleaning device used for an image forming apparatus such as a copying machine or a printer. The present invention also relates to a charging device and an image forming apparatus which include the cleaning device.

BACKGROUND OF THE INVENTION

In an image forming apparatus using electrophotography, image formation processes as follows are generally performed. Specifically, a surface of a photosensitive drum (image bearing member) is uniformly charged with a predetermined polarity and potential by a charging device. Then, an electrostatic latent image of an original image is formed by an exposure device. Next, the electrostatic latent image is developed by a developing device. As a result, a toner image is formed on the surface of the photosensitive drum. The toner image is transferred to a sheet in a transfer section. As an alternative method, the toner image is not directly transferred from the photosensitive drum to the sheet, but is transferred to the sheet through an intermediation of an intermediate transferring member as a transfer belt.

There exists a charging device using a roller-shaped charging member (charging roller) as the charging device that charges the surface of the photosensitive drum. The charging roller is provided to be in contract with the surface of the photosensitive drum or in proximity thereto. A predetermined voltage is applied to the charging roller to charge the surface of the photosensitive drum.

On the other hand, after the toner image is transferred to the sheet, an extremely small amount of toner or components thereof, paper powder, or the like remains on the surface of the photosensitive drum. The residual material electrostatic adhering to the surface of the photosensitive drum becomes an obstacle to a next image formation process, and hence the surface of the photosensitive drum is cleaned. However, there arises a problem of the physical adhesion of the residual material to the charging roller, which is caused by the imperfect cleaning of the surface of the photosensitive drum.

In particular, if the amount of toner components (external additive for a toner) physical adhering to the surface of the charging roller increases, a phenomenon that the surface of the charging roller is whitened (hereinafter, the phenomenon is referred to as "whitening") occurs. When the surface of the charging roller is whitened, an electric resistance of the surface of the charging roller increases. As a result, the whitened portion of the surface of the charging roller becomes less likely to be charged. Moreover, a partial whitening of the surface of the charging roller causes nonuniformity in charging in a corresponding portion of the surface of the photosensitive drum. As described above, the physical adhesion of the external additive for the toner to the surface of the charging roller becomes an obstacle to uniform and suitable charging of the surface of the photosensitive drum. Therefore, the surface of the charging roller is required to be cleaned.

A brush roller as a cleaning device for the charging roller is well known. The brush roller includes brush filaments which clean the surface of the charging roller during contact. The brush filaments remove external additive of the toner adhering to the surface of the charged roller, as well as disperse the external additive of the toner. As a result, nonuniformity in charging of the surface of the photosensitive drum is inhibited. In order to clean the charged roller properly, the brush roller needs to contact the charging roller orthogonally at a predetermined pressure. Thus, if the rotation of the brush roller is stopped, a plastic deformation of the brush filaments is caused. The plastic deformation causes the brush filaments to flatten (hereinafter, this state is referred to as "flattening of the brush filaments"). If flattening of the brush filaments occurs, the cleaning performance for the charging roller is remarkably lowered. Therefore, it is difficult to maintain the cleaning performance of the brush roller over a long period of time.

SUMMARY OF THE INVENTION

The present invention provides a cleaning device capable of cleaning of a charging member. The present invention also provides an image forming apparatus including the cleaning device.

According to an embodiment, a cleaning device may include: a cleaning device which includes a brush roller, having brush filaments. In some embodiments, an inorganic microparticle may be bonded to tips of the brush filaments. An embodiment may include the brush roller contacting a surface of a member to be cleaned and thus, cleaning the surface of the member.

The above and other objects, features, and advantages of the present invention will be more apparent from the following detailed description of embodiments taken in conjunction with the accompanying drawings.

In this text, the terms "comprising", "comprise", "comprises" and other forms of "comprise" can have the meaning ascribed to these terms in U.S. Patent Law and can mean "including", "include", "includes" and other forms of "include".

The various features of novelty which characterize the invention are pointed out in particularity in the claims annexed to and forming a part of this disclosure. For a better understanding of the invention, its operating advantages and specific objects attained by its uses, reference is made to the accompanying descriptive matter in which exemplary embodiments of the invention are illustrated in the accompanying drawings in which corresponding components are identified by the same reference numerals.

BRIEF DESCRIPTION OF THE DRAWINGS

The following detailed description, given by way of example, but not intended to limit the invention solely to the specific embodiments described, may best be understood in conjunction with the accompanying drawings, in which.

DETAILED DESCRIPTION OF THE EMBODIMENTS

Reference will now be made in detail to various embodiments of the invention, one or more examples of which are illustrated in the accompanying drawings. Each example is provided by way of explanation of the invention, and by no way limiting the present invention. In fact, it will be apparent to those skilled in the art that various modifications, combinations, additions, deletions and variations can be made in the present invention without departing from the scope or spirit of the present invention. For instance, features illustrated or described as part of one embodiment can be used in another embodiment to yield a still further embodiment. It is intended that the present invention covers such modifications, combinations, additions, deletions, applications and variations that come within the scope of the appended claims and their equivalents.

Figure 1:
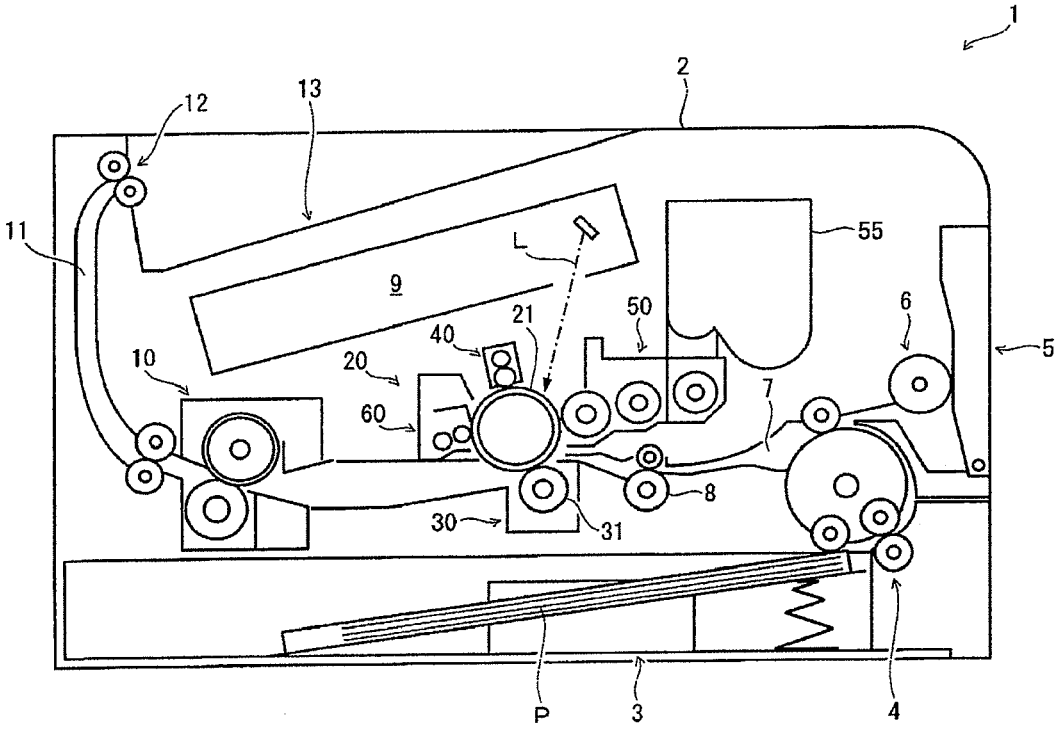
FIG. 1 is a sectional view depicting an internal structure of a printer to which a cleaning device according to the present invention is applied.

FIG. 1 is a sectional view for illustrating an internal structure of a printer to which a cleaning device may be applied. As shown in FIG. 1, sheet feeding cassette 3 is positioned in a lower part of main body 2 of printer 1. A stack of sheets P is accommodated in sheet feeding cassette 3. Sheet feeding device 4 may be provided above at the downstream in a direction of conveyance of the sheet feeding cassette 3. Sheet "P" may be fed by sheet feeding device 4 in an upper right direction from the sheet feeding cassette 3. Sheet feeding cassette 3 can be horizontally slid in a right-hand direction in FIG. 1 to be pulled out.

In an embodiment of printer 1, manual sheet feed tray 5 may be provided. As illustrated in FIG. 1, manual sheet feed tray 5 may be positioned in a folded state on an inner surface of a right wall of the main body 2. Manual sheet feed tray 5 may be moved in a right-hand direction about a spindle provided in a lower part to be unfolded. For use, sheet P may be placed on an upper surface of manual sheet feed tray 5 in the unfolded state.

The manual sheet feed tray 5 is used to feed a sheet such as a special-sized sheet, an envelope, cardboard, an OHP sheet, and any other recording medium known in the art. The sheet placed on the manual sheet feed tray 5 may be fed to the inside of the main body 2 by a sheet feeding device 6 for manual sheet feed tray, which is provided on the left of the manual sheet feed tray 5 in FIG. 1. The manual sheet feed tray may be closed as illustrated in FIG. 1 when not in use.

A sheet conveying path 7, a pair of registration rollers 8, an image forming section 20, and a transfer section 30 are provided downstream of the sheet feeding cassette 3 and the manual sheet feed tray 5 to the direct the sheet. In an embodiment, sheet P may be sent out from either sheet feeding cassette 3 or manual sheet feed tray 5 such that sheet P passes through sheet conveying path 7 to reach registration rollers 8. Registration rollers 8 may be configured to send sheet P to transfer section 30 at a time corresponding to the formation of a toner image in image forming section 20. Sometimes a sheet may be fed improperly, such that the sheet is skewed. In an embodiment, positioning of a skewed sheet may be corrected at registration roller 8. Then, sheet P may be conveyed to image forming section 20 such that the toner image is transferred to sheet P in proper alignment.

When an image data signal from an external computer is transmitted to the printer, a laser beam may be used to transit the signal to a device. For example, a data signal transferred to printer 1 from an external computer (not shown) may be further transferred to optical scanning device 9 as shown in FIG. 1. Laser beam "L" represented in FIG. 1 by an alternate long and short dash line may be emitted from optical scanning device 9 positioned above image forming section 20. As a result, an electrostatic latent image of an original image is formed on photosensitive drum 21 of image forming section 20. A toner image is developed on the electrostatic latent image by developing device 50. The toner image is transferred to the sheet P, which is conveyed by registration rollers 8, at a transfer nip portion at which photosensitive drum 21 and transferring roller 31 of the transfer section 30 are in contact with each other.

An embodiment may include fixing device 10 provided downstream of image forming section 20 and transfer section 30 in the direction of conveyance of the sheet. The sheet P bearing the toner image transferred in transfer section 30 is conveyed to fixing device 10, in which the toner image is heated and pressurized by a heating roller and a pressure roller to be fixed on sheet P.

In an embodiment, sheet conveying path 11 for delivery, sheet outlet 12, and sheet conveyance section 13 may be located downstream of fixing device 10. Sheet P discharged from fixing device 10 may be sent upward through sheet conveying path 11 to be delivered through sheet outlet 12 to sheet conveyance section 13 provided on an upper surface of the main body 2.

Figure 2:
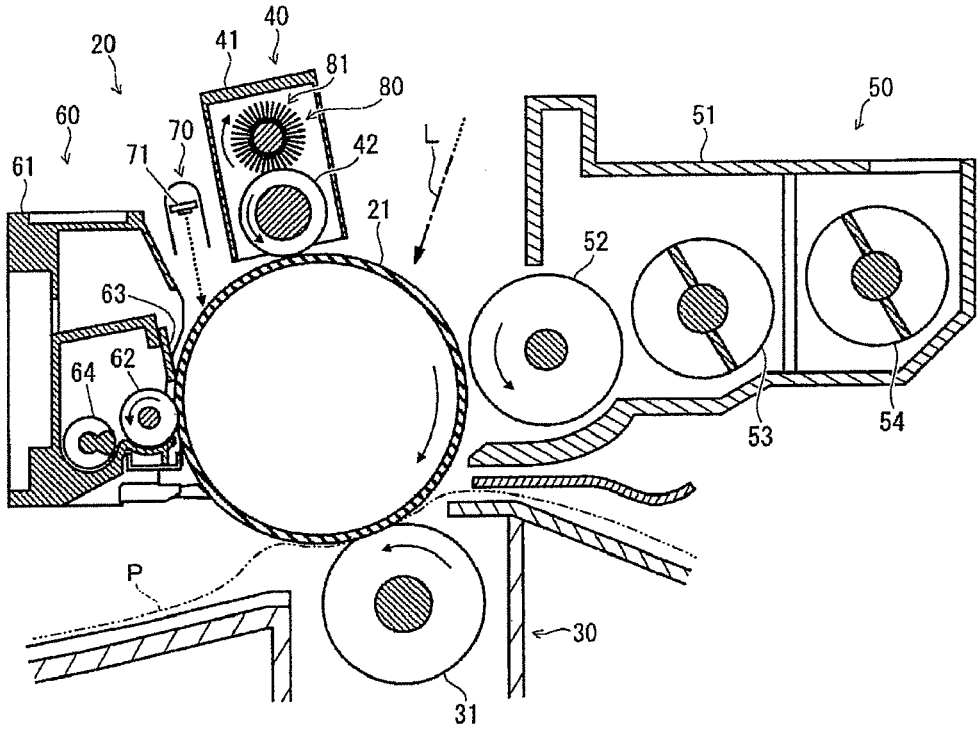
FIG. 2 is a partial sectional view depicting a periphery of an image forming section of the printer.

FIG. 2 is a partial sectional view depicting a periphery of the image forming section of the printer. Photosensitive drum (i.e., image bearing member) 21 is provided in the center of image forming section 20. As illustrated in FIG. 2, charging device 40, developing device 50, cleaning device 60 for the photosensitive drum, and neutralization device 70 may be arranged in the stated order in a direction of rotation of photosensitive drum 21. Transfer section 30 may be provided between developing device 50 and cleaning device 60 for the photosensitive drum.

In an embodiment, photosensitive drum 21 may include an electrically conductive cylindrical base and a photosensitive layer. The electrically conductive cylindrical base may be made of any conductive material such as aluminum or the like. Some embodiments may include the photosensitive layer positioned proximate the cylindrical base. For example, the photosensitive layer may be provided on the base. In an embodiment, the photosensitive layer may a thickness in a range from about 0.1 μm to about 100 μm. Yet other embodiments, utilize a photosensitive layer having a thickness in a range from about 10 μm to about 50 μm. In an embodiment, the photosensitive layer may be made of, but is not limited to amorphous silicon. Photosensitive drum 21 has a diameter of 30 mm. The photosensitive drum 21 is rotated by a driving device (not shown), the rotational speed thereof measured at its outer circumference being the same as a sheet conveying speed (160 mm/s in the case of printer 1).

As shown in FIG. 2, some embodiments of charging device 40 may include housing 41. In some embodiments, charging roller 42 may be positioned substantially within housing 41. In addition, a portion of the charging roller may extend beyond the housing in an embodiment. Charging roller 42 may be positioned within housing 41 such that it contacts photosensitive drum 21 at a predetermined pressure. In some embodiments, charging roller 42 may rotate with the rotation of the photosensitive drum 21. In an embodiment, a surface of the photosensitive drum 21 may be uniformly charged by the charging roller 42 to have a predetermined potential of in a range from about +250V to about +350V. For example, in an embodiment the charging roller may have a predetermined potential of in a range from about DC bias of +400V to +800V, AC bias of in a range from about 0.9 KV to 1.8 KV and a frequency of in a range from 1.2 KHz to 4.0 Hz in the case of printer 1. An embodiment may include cleaning element 80 in housing 41. As shown in FIG. 2, cleaning device may be positioned on the opposite of charging roller 42 to photosensitive drum 21. Alternatively, the cleaning device may be positioned at any point contacting the charging roller. Cleaning element 80 may include brush roller 81 configured to contact charging roller 42 and to clean a surface of charging roller 42.

An embodiment of developing device 50 includes housing 51. Developing roller 52, a conveying screw 53, and a stirring screw 54 are provided in the housing 51 as shown in FIG. 2. During use a surface of developing roller 52 may be covered with a developer and/or toner in the vicinity of the photosensitive drum 21. In some embodiments, a bias having the same polarity as a charging polarity of the photosensitive drum 21 may be applied to the developing roller 52. For example, a positive bias may be applied to developing roller 52 in the case of printer 1 as shown in FIG. 2. When the toner is charged to have a positive polarity, the electrostatic latent image develops on the surface of photosensitive drum 21 in developing device 50.

In an embodiment, toner used in printer 1 may include a small amount of microparticles of a titanium oxide as an external additive component. This external additive component may be used to polish the surface of the photosensitive drum 21. As shown in FIG. 1, the toner may be stored in toner feeding container 55. Toner feeding container 55 may be positioned above the developing device 50. In some embodiments, toner may be supplied into housing 51 (shown in FIG. 2) from above stirring screw 54 by supply means (not shown). The supplied toner may be conveyed developing roller 52 while being stirred by stirring screw 54 and conveying screw 53 in developing device 50 as shown in FIG. 2.

As shown in FIG. 1, transfer section 30 may include transferring roller 31. Sheet P passes through the transfer nip portion formed by transferring roller 31 and photosensitive drum 21. Transferring roller 31 may be rotated at the same circumferential speed as that of photosensitive drum 21 by a driving device (not shown). In alternate embodiments, the transferring roller may be rotated a circumferential speed that differs from the photosensitive drum. In some embodiments, a transfer bias having the polarity opposite to the charging polarity of the toner may be applied to the transferring roller 31. For example, a negative bias may be applied to transferring roller 31 in the case of printer 1 shown in FIG. 1. In FIG. 2, a path through which the sheet P may be conveyed is indicated by an alternate long and two short dashes line.

In some embodiments, cleaning device 60 for the photosensitive drum may be provided on a downstream side of the transfer nip portion along the direction of rotation of photosensitive drum 21 as shown in FIG. 1. Cleaning device 60 for the photosensitive drum has housing 61, and includes cleaning roller 62, cleaning blade 63, and toner discharging screw 64, which are provided in housing 61. Cleaning roller 62 and cleaning blade 63 are in pressure contact with photosensitive drum 21. The cleaning roller and the cleaning blade may remove an adhering material, such as a residual toner present on the surface of the photosensitive drum 21, after the transfer of the toner image onto the sheet P. In some embodiments, the residual adhering material removed from the surface of the photosensitive drum 21 may be collected and temporarily stored in housing 61. The stored material may then be discharged by the toner discharging screw 64 to a waste toner collecting container (not shown) provided outside of the cleaning device 60 for the photosensitive drum. Alternatively, the residual adhering material removed from the surface of the photosensitive drum may be discharged directly through toner discharging screw 64.

As shown in FIG. 2, neutralization device 70 may include LED 71. An electroluminescence (hereinafter "EL") light source, a fluorescent tube, or the like may be used in place of LED 71. Neutralization device 70 irradiates photosensitive drum 21 with light emitted from LED 71 to remove charges on photosensitive drum 21 prior to a subsequent charging step.

Figure 3:
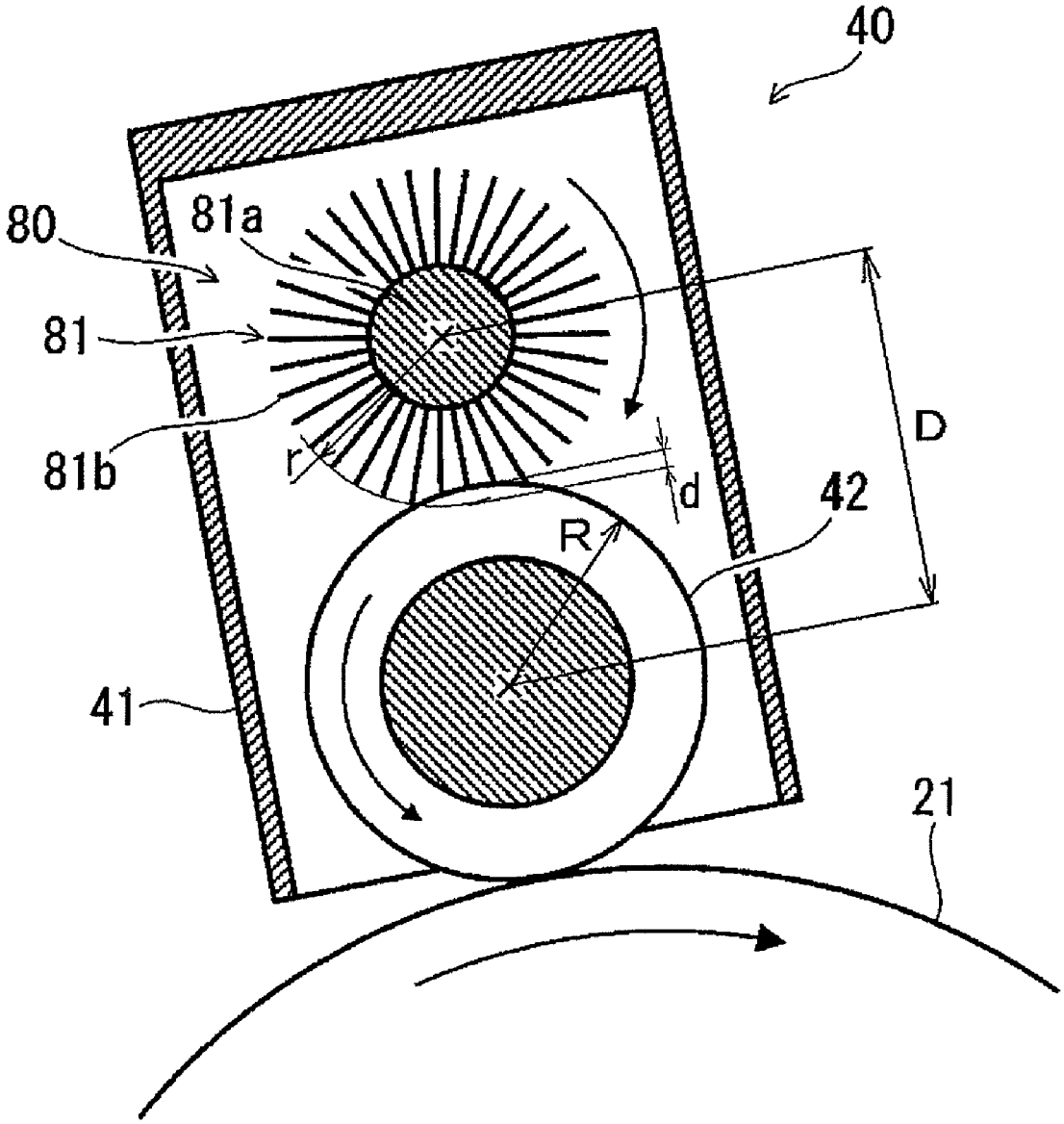
FIG. 3 is a partial sectional view depicting a charging device which is applied to the image forming section of the printer.

FIG. 3 is a partial sectional view of the charging device which is applied to the printer 1 (shown in FIG. 2). Charging device 40 may include charging roller 42 and cleaning element 80 for charging roller 42, which are provided in housing 41 (FIG. 3).

Charging roller 42 is a roller member having a diameter in a range from about 6 mm to about 30 mm. In some embodiments, a diameter of the charging roller may be in a range from about 8 mm to about 20 mm. For example, a charging roller may have a diameter of about 12 mm. Charging roller 42 may include a rotatably supported shaft portion having a diameter of in a range from about 3 mm to about 15 mm. For example, a charging roller with a diameter of 12 mm may have a shaft portion having a diameter of about 6 mm. Further, some embodiments may include an elastic member provided on a circumference of the shaft portion. The shaft portion of charging roller 42 may be connected to a voltage supplying means (not shown). In some embodiments, a voltage obtained by superimposing an AC voltage on a DC voltage is supplied to the shaft portion of the charging roller 42. The elastic member of the charging roller 42 may be made of, but is not limited to semi-conductive synthetic rubber, such as epichlorohydrin rubber. An embodiment of the elastic member may have an electric resistance value (volume resistivity) of about $3\times10^5$ Ω·cm and a rubber hardness of 40 (JISA). In some embodiments, a coating may be provided on an outer circumferential surface of the elastic member. Coatings for the elastic member may include, but may not be limited to polyamide resins or any other known coating in the art. Some embodiments may include a coating having a thickness of about 5 μm. An elastic member including the coating may have a hardness of about 41 (JISA).

An embodiment of a cleaning element may include a brush configured to contact the surface of a member to clean the member. In some embodiments, brush 81 may be a rotatable member. For example, as shown in FIG. 3 a brush, such as brush roller 81 may be used to clean a surface of charging roller 42. FIG. 3 depicts brush roller 81 which includes a rotatable support structure 81*a* made of a metal and brush filaments 81*b*. In some embodiments, brush filaments may extend from the support structure. Each brush filament may have a tip at the distal end from the support structure. Brush filaments may be configured to contact a surface of a member such that the member can be cleaned during use by the brush. Brush filaments may be provided on an external surface of support structure 81*a*. For example, as depicted in FIG. 3, brush filaments 81*b* may extend from support structure 81*a* radially. Further, some embodiments may include spacing brush filaments 81*b* equidistantly around the circumference of support structure 81*a*. An embodiment of a brush roller may have a diameter in a range from about 4 mm to about 50 mm. Alternatively, a brush roller may have a diameter in a range from about 6 mm to about 30 mm. For example, brush roller 81 may have a diameter of about 12 mm.

In some embodiments, a power transmission device (not shown) may be connected to shaft portion 81*a* of brush roller 81. Power may be transmitted from a power source of photosensitive drum 21 through an intermediation of a gear to rotate brush roller 81. Brush roller 81 rotates in the same direction as that of the surface of charging roller 42 at a portion in contact with charging roller 42. In some embodiments, a value of the ratio of a circumferential speed of brush roller 81 to that of charging roller 42 may be within a range from about 0.5 to about 2.0.

Figure 4:
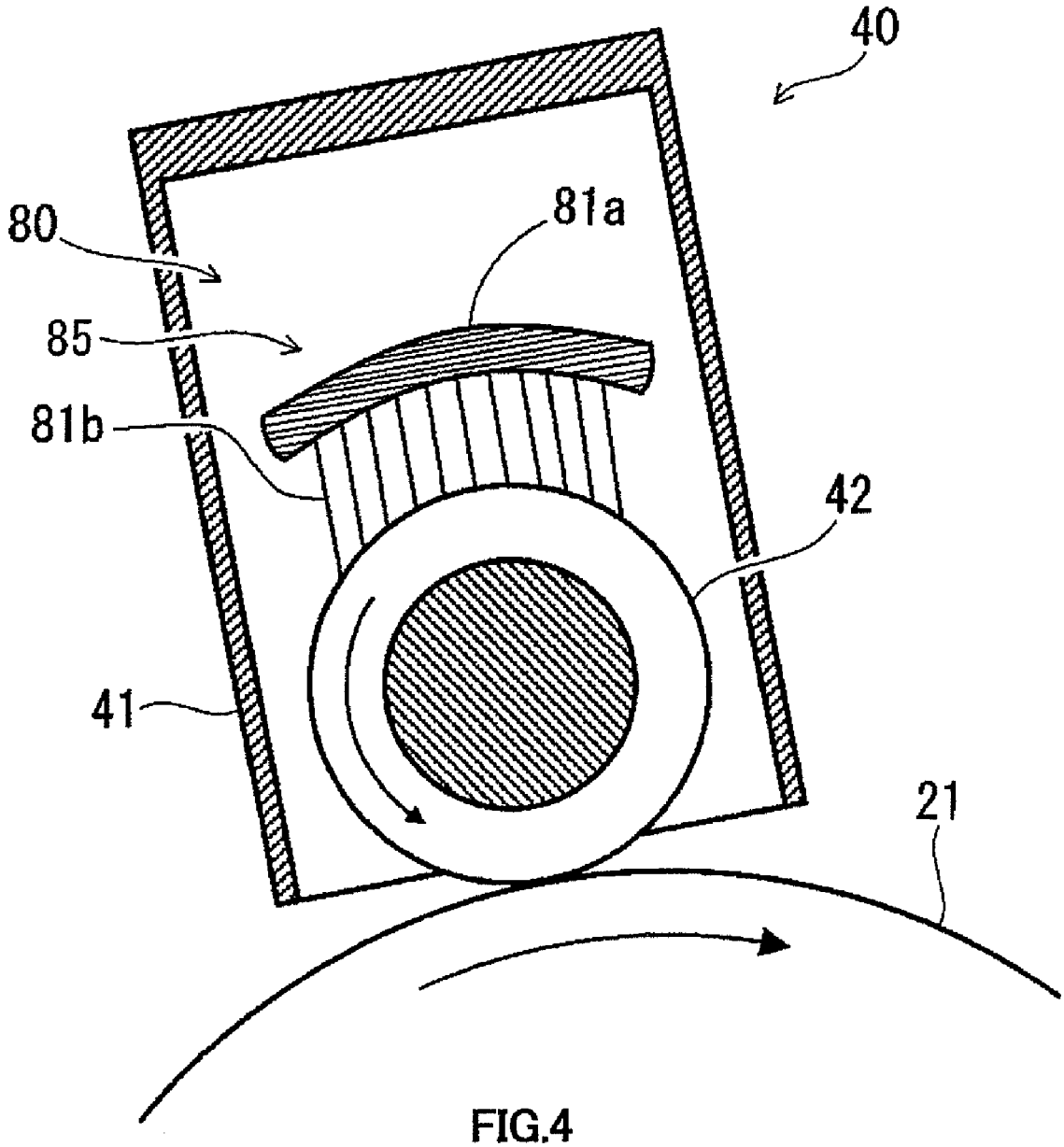
FIG. 4 is a partial sectional view depicting a charging device which is applied to the image forming section of the printer.

In some alternate embodiments, a brush may be a stationary part. For example as shown in FIG. 4, brush 85 may be stationary. Brush filaments may extend from support structure toward a member to be cleaned. In some embodiments, any member of the image forming apparatus may be cleaned by the brush including, but not limited to any rotary member in the device, such as the charging roller, the photosensitive drum, and/or the intermediate transferring member.

Figure 5:
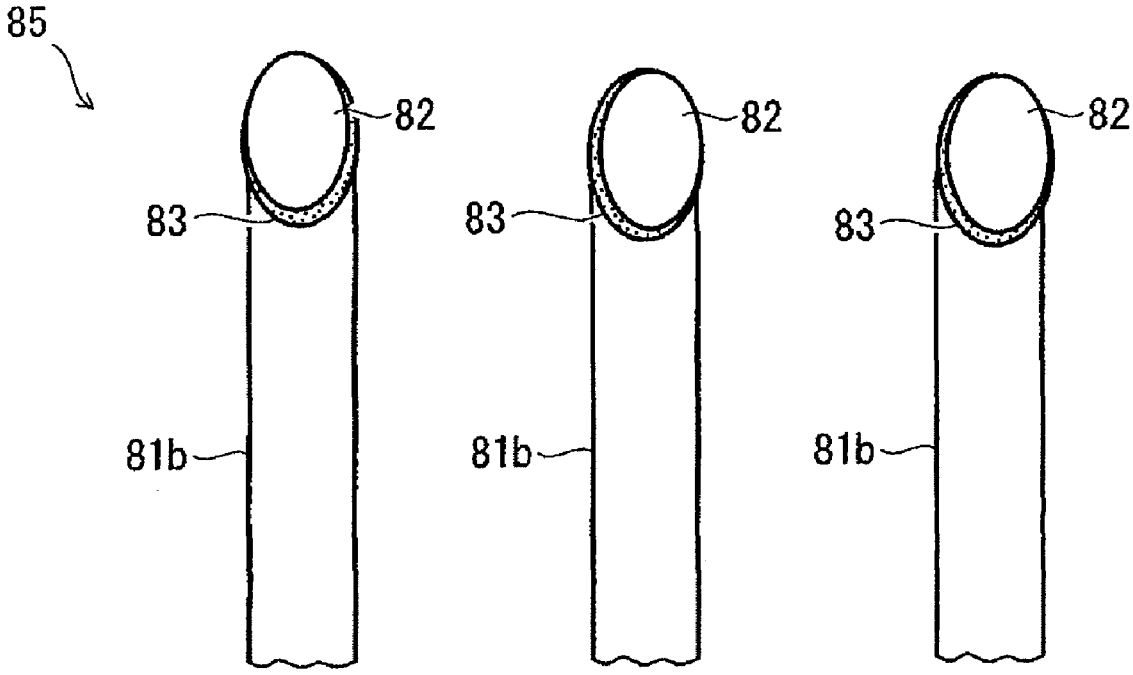
FIG. 5 is a partial enlarged view depicting tips of brush filaments to which the present invention is applied.

FIG. 5 is a partial enlarged view illustrating tips of brush filaments to which the present invention is applied. Brush filaments 81*b* of brush 81 are provided on the outer surface of shaft portion 81*a* and extend radially therefrom. Brush filaments 81*b* may be made from various materials including, but not limited to fibers, nylon synthetic fibers, such as 6-nylon or 12-nylon, polyester synthetic fibers, acrylic synthetic fibers, any material known in the art or combinations thereof. In some embodiments, individual brush filaments 81*b*, as shown in FIG. 5, may have a linear mass density of fibers in a range from about 0.1 denier to about 10 denier (thickness of fibers are in a range from about 5 μm to about 70 μm). Some embodiments may include brush filaments having a linear mass density of fibers in a range from about 1 to about 6 denier (thickness of fibers are in a range from about 20 μm to about 50 μm). Some embodiments may include brush filaments having a linear mass density of fibers less than about 2 denier (thickness of fibers are less than about 30 μm). For example, brush filaments having a linear mass density of less than about 2 denier may be used when cleaning microparticles in the external additive from roller which have a particle diameter of less than about 1 μm. As the linear mass density of each of the brush filaments is increased, the stiffness of the brush filaments is also increased. Thus, increasing a linear mass density of the brush filaments may increase a rotary torque of the brush roller 81. If the linear mass density of the brush filaments is increased above a pre-determined range irregular rotation becomes more likely to occur. Brush filaments 81*b* of a printer may be positioned on support structure 81*a* at a density of 40000 filaments/$cm^2$.

In some embodiments, a brush resistance value may be within a range from about $1\times10^5$ to about $1\times10^9\Omega$. "Brush resistance value" generally refers to a resistance value calculated from the applied voltage and the measured current. To measure a brush resistance value a brush roller may be rotated a predetermined number of revolutions while a metal roller having a diameter of about 20 mm is in contact with the brush roller with a fitting amount of about 1.0 mm. "Fitting amount" refers to the pre-determined distance by which the center distance between the brush roller and the metal roller is less than a distance obtained by adding a radius of the metal roller and a radius of the brush roller. Then, a pre-determined voltage may be applied between the shaft portion of the brush roller and the metal roller to measure a current flowing therebetween. The resistance value calculated from the applied voltage and the measured current is the brush resistance value.

An embodiment may include the addition of carbon black to the brush filaments. Carbon black may impart electrical conductivity to the brush filaments. Further, use of carbon black may inhibit the accumulation of charge on the brush roller.

In some embodiments, inorganic microparticles 82 are bonded to tips of the brush filaments 81*b*. Inorganic microparticles 82 may include, but are not limited to titanium oxide, silica, materials known in the art, or combinations thereof. In an embodiment, an additive used in the toner may be used as the inorganic microparticles 82. For example, the toner used in printer 1 may include a small amount of titanium oxide microparticles as an external additive component to polish the surface of photosensitive drum 21. Here, the titanium oxide microparticles may be used as the inorganic microparticles 82. In some embodiments, a diameter of the inorganic microparticles may be selected to conform with a diameter of the external additive. For example, a diameter of each of the inorganic microparticles 82, may be less than about 1 μm, which corresponds to the diameter of the titanium oxide serving as the external additive of the toner used in the printer 1.

In some embodiments, the inorganic microparticles may be coupled to the brush filaments. Methods of coupling the inorganic microparticles 82 to the tips of the brush filaments 81*b* may include bonding as described herein. For example, as shown in FIG. 5, inorganic microparticles 82 may be bonded to the tips of brush filaments 81*b*.

In an embodiment, microparticles may be bonded to the brush filaments using high voltage. For example, a voltage application device may be used to apply a high voltage to a metal roller in contact with the brush filaments. In some embodiments, the brush roller may be rotated during application of the high voltage. The brush roller may be mounted to the voltage application device. High voltage may be applied to the tips of the brush filaments while the brush roller is rotated with inorganic microparticles. In the presence of the voltage, a micro-discharge may be generated between the vicinity of the tips of the brush filaments 81*b* and the metal roller to form a discharge product 83 at the tips of brush filaments 81*b* as depicted in FIG. 5. Discharge product 83 may serve as an adhesive to firmly bond inorganic microparticles 82 to brush filaments 81*b*.

In some embodiments, an AC bias may be superimposed on the voltage applied to the metal roller. For example, an AC bias at Vpp of 1.0 to 2.0 kV and a frequency of 1.0 to 3.0 kHz may be superimposed. When bonding the microparticles 82 to the brush filaments 81*b*, the number of discharges may be increased by superimposing an AC bias on the voltage applied to the metal roller. As a result, time necessary for bonding may be reduced.

In an embodiment, the inorganic microparticles may be bonded to the brush filaments using heat. The brush roller may be rotated to bring the tips of the brush filaments into contact with a heat pipe at a high temperature. The inorganic microparticles may temporarily adhere to the tips of the brush filaments. The tips of the brush filaments are melted by the heat of the heat pipe and adhesively bond inorganic microparticles to the tips of the brush filaments.

Some embodiments may include using an adhesive to couple the inorganic microparticles to the brush filaments. After the application of an adhesive to the tips of the brush filaments, the inorganic microparticles may adhere to the brush filaments. Along with the curing of the adhesive, the inorganic microparticles are bonded to the tips of the brush filaments.

As is shown in FIG. 3, the tips of brush filaments 81*b* of brush roller 81 come into contact with the surface of charging roller 42. Specifically, a portion of brush roller 81, to which the external additive microparticles 82 are bonded, may contact the surface of the charging roller 42. Thus, during rotation brush roller 81 may clean the surface of the charging roller 42 in a rubbing fashion. In some embodiments, a center distance D between the brush roller 81 and the charging roller 42 may be set smaller than a distance obtained by adding a radius "R" of the charging roller 42, a radius "r" of the brush roller 81 and a predetermined distance "d". As shown in FIG. 3, the predetermined distance "d" may be referred to as the "fitting amount d". As depicted in FIG. 1, an embodiment may include printer 1 having a value for the fitting amount d of about 0.5 mm. In some embodiments, a distance between the brush roller 81 and the charging roller 42 is in a range from about 0.1 mm to about 3 mm. In some embodiments, the fitting amount, "d" may be set equal to or less than about 40% of the length of the brush filaments. In addition, some embodiments may include a value for the fitting amount "d" in a range from about 0.2 to about 1.5 mm.

EXAMPLES

A comparative experiment between a case where an embodiment of the herein described cleaning element was utilized (example) and a case where cleaning did not occur (comparative example) was conducted using the printer 1 as shown in FIG. 1.

For the case where the herein described cleaning element was utilized (example), titanium oxide (EC-100 fabricated by Titan Kogyo Ltd.) corresponding to the external additive for the toner used in the printer 1 was used. As a method of bonding the inorganic microparticles 82 to the tips of the brush filaments 81*b*, the above-described high voltage bonding method was used. As conditions of carrying out the high voltage bonding method, the rotation speed of the brush roller was 200 rpm, the voltage applied between the brush roller and the metal roller was 3 to 5 kV, the fitting amount of the brush roller 81 to the metal roller was 1.0 mm. The brush filaments used on the brush roller 81 were filaments of 6-nylon (conductive fiber) having a linear mass density of 2 denier (thickness is about 30 μm). An electrical resistance value of the brush filaments was $1\times10^6\Omega$.

In the comparative example, the brush roller 81 operated under the same conditions as those of the example described above except for the omission of the process of bonding the inorganic microparticles 82 to the tips of the brush filaments 81*b*.

Comparative Experiment

One hundred thousand sheets were continuously printed by using the printer 1. A coverage of the sheet surface with the print toner was set to 5% for all the sheets. An image density unevenness was evaluated for image samples of 1×1-dot 25% halftone image at 600 dpi, which were obtained after the completion of printing. For the evaluation of the image density unevenness, measurement data obtained by a transmission densitometer, Model 310T, fabricated by X-Rite, Inc. was used. With the densitometer, when a measured value of the unevenness in image density (transmission density) was 0.1 or less, the result was evaluated as good (indicated by a circle). On the other hand, when the measured value exceeded 0.1, the result was evaluated as bad (indicated by a cross).

The results are shown in table 1. In the case where the present invention was not carried out (comparative example), the unevenness in image density was remarkable (0.15; the result of evaluation is indicated by a cross). In the case where the present invention was carried out (example), however, the unevenness in image density was extremely small (0.08; the result of evaluation is indicated by a circle) even after one hundred thousand sheets were printed, and therefore, was greatly improved.

TABLE 1

| INORGANIC MICROPARTICLES AT TIPS OF BRUSH FILAMENTS | MEASURED VALUE OF DENSITY UNEVENNESS | EVALUATION |
|---|---|---|
| BONDED (EXAMPLE) | 0.08 | Good • ○) |
| NOT BONDED (COMPARATIVE EXAMPLE) | 0.15 | Bad • X) |

The result as described above is obtained by bonding the inorganic microparticles to the tips of the brush filaments so as to facilitate the recovery of the external additive in the toner, which has adhered to the surface of the charging roller 42 in the vicinity of the inorganic microparticles. Further, the above-described effect is maintained even when the flattening of brush filaments occurs. Accordingly, the external additive in the toner, which has adhered to the surface of the charging roller, is efficiently removed by the brush filaments, and hence charging performance and image quality can be maintained for a long period of time.

Although the embodiment of the present invention has been described above, the scope of the present invention is not limited thereto. For example, the following modifications may be made.

A printer may include an image forming apparatus for monochrome printing, which uses a black toner alone. In some embodiments, a printer may include a tandem type or rotary rack type image forming apparatus for color printing, which includes an intermediate transferring member which is capable of forming an image by superimposing a plurality of colors.

In some embodiments, the cleaning element for the charging roller of the charging device may be utilized with any rotary member in a printer. For example, the cleaning element may be used in combination with the photosensitive drum, cleaning the surface of the photosensitive drum 21. In addition, some embodiments may include utilizing a cleaning element to clean the intermediate transferring member in the image forming-apparatus.

Components to be bonded to the tips of the brush filaments may include, but are not limited to any components in the toner, any components in the paper, inorganic microparticles, such as titanium oxide, silica, alumina, other materials known in the art or combinations thereof. For example, inorganic particles bonded to the tips of the brush filaments may correspond to components in the toner, such as external additives. Therefore, use of the materials bonded to the brush filaments may allow for removal of the corresponding materials from any member to be cleaned. Further, in some embodiments, inorganic microparticles in the paper may be bonded to the brush filaments, to induce removal of paper powder components.

With the configurations described herein, an image forming apparatus may be provided, which is capable of performing high-quality image formation over a long period of time.

Having thus described in detail preferred embodiments of the present invention, it is to be understood that the invention defined by the foregoing paragraphs is not to be limited to particular details and/or embodiments set forth in the above description, as many apparent variations thereof are possible without departing from the spirit or scope of the present invention.

What is claimed is:

1. A cleaning element for an image forming apparatus, comprising:

a brush comprising:

a support structure;

brush filaments extending from the support structure, each brush filament having a tip at the distal end from the support structure and configured to contact a surface of a member such that the member can be cleaned during use by the brush; and an inorganic microparticle bonded at or proximate to the tips of the brush filaments by a discharge product as an adhesive.

2. The cleaning element according to claim 1, wherein the inorganic microparticle has a diameter of less than about 1 μm.

3. The cleaning element according to claim 1, wherein the inorganic microparticle is selected from the group consisting of a titanium oxide compound, a silica compound, an alumina compound, and combinations thereof.

4. The cleaning element according to claim 1, wherein a linear mass density of each of the brush filaments falls within a range of about 1 to about 6 denier.

5. The cleaning element according to claim 1, wherein the brush filaments comprise a synthetic fiber.

6. The cleaning element according to claim 1, wherein the inorganic microparticle is comprised of a component of toner or a component of paper, whereby the toner or paper dust on the member is attracted to the brush filament.

7. A charging device used for an image forming apparatus, comprising:

a charging roller; and a cleaning element having a brush, wherein the brush comprises:

a support structure;

brush filaments extending from the support structure, each brush filament having a tip at the distal end from the support structure and configured to contact a surface of a charging roller such that the charging member can be cleaned during use by the brush; and an inorganic microparticle bonded at or proximate to the tips of the brush filaments by a discharge product as an adhesive.

8. The charging device according to claim 7, wherein the inorganic microparticle has a diameter of less than about 1 μm.

9. The charging device according to claim 7, wherein the inorganic microparticle is selected from the group consisting of a titanium oxide compound, a silica compound, an alumina compound, and combinations thereof.

10. The charging device according to claim 7, wherein a linear mass density of each of the brush filaments falls within a range from about 1 denier to about 6 denier.

11. The charging device according to claim 7, wherein the brush filaments comprise synthetic fibers.

12. The charging device according to claim 7, wherein the charging roller is made of synthetic rubber.

13. The charging device according to claim 7, wherein the inorganic microparticle is comprised of a component of toner or a component of paper, whereby the toner or paper dust on the member is attracted to the brush filament.

14. An image forming apparatus, comprising:

an image forming section comprising:

an image carrier;

a charging device comprising:

a cleaning device having a brush roller comprising:

a support structure;

brush filaments extending from the support structure, each brush filament having a tip at the distal end from the support structure and configured to contact a surface of a member such that the member can be cleaned during use by the brush; and an inorganic microparticle bonded at or proximate to the tips of the brush filaments by a discharge product as an adhesive.

15. The image forming apparatus according to claim 14, wherein the inorganic microparticle has a diameter of less than about 1 μm.

16. The image forming apparatus according to claim 14, wherein the charging device charges a photosensitive drum.

17. The image forming apparatus according to claim 14, wherein the inorganic microparticle is comprised of a component of toner or a component of paper, whereby the toner or paper dust on the member is attracted to the brush filament.

18. A method for cleaning a surface of a member in an image forming apparatus comprising:

contacting the surface with a brush comprising:

a support structure;

brush filaments extending from the support structure, each brush filament having a tip at the distal end from the support structure, and configured to contact a surface of a member such that the member can be cleaned during use by the brush; and an inorganic microparticle bonded at or proximate to the tips of the brush filaments by a discharge product as an adhesive.

19. The method of claim 18 wherein the inorganic microparticle is comprised of a component of toner or a component of paper, whereby the toner or paper dust on the member is attracted to the brush filament.

20. A system for cleaning an image forming apparatus, comprising:

a cleaning element configured to clean a member comprising:

filaments configured to contact a surface of the member at a first tip of the filaments such that the member can be cleaned during use by the cleaning element; and one or more components bonded at or proximate to the first tip of the filaments by a discharge product as an adhesive, wherein the one or more components is comprised of a material to be removed from the member and the material to be removed is attracted to the filaments configured to contact a surface of the member such that the member may be cleaned during use.

* * * * *